United States Patent [19]

McMaster et al.

[11] 4,265,106

[45] May 5, 1981

[54] PIPE-BENDING APPARATUS

[76] Inventors: Tom McMaster; Thomas Reid, both of 31 Movenis Hill, both of Garvagh, England

[21] Appl. No.: 41,845

[22] Filed: May 24, 1979

[30] Foreign Application Priority Data

May 31, 1978 [GB] United Kingdom ..... 24693/78

[51] Int. Cl.[3] ..... B21D 7/03

[52] U.S. Cl. ..... 72/389

[58] Field of Search ..... 72/389, 386, 381, 212, 72/213, 217

[56] References Cited

U.S. PATENT DOCUMENTS

| | | | |
|---|---|---|---|
| 2,464,459 | 3/1949 | Newlon | 72/389 |
| 3,105,339 | 7/1965 | Lang | 72/389 |
| 3,429,157 | 2/1969 | Huth | 72/389 |
| 3,908,425 | 9/1975 | Ware | 72/389 |
| 4,141,235 | 2/1979 | Ishihara | 72/213 |

FOREIGN PATENT DOCUMENTS

| | | | |
|---|---|---|---|
| 2050852 | 4/1971 | France | 72/389 |
| 850248 | 10/1960 | United Kingdom | 72/389 |

*Primary Examiner*—Leon Gilden
*Assistant Examiner*—Gene P. Crosby
*Attorney, Agent, or Firm*—Reising, Ethington, Barnard, Perry & Brooks

[57] ABSTRACT

A pipe-bending apparatus comprises an elongate structure having a longitudinal work surface at, or adjacent to, opposite ends of which clamping means and a former are respectively mounted. The former is held fast on the work surface, and the clamping means is power-driven towards and away from it by a double-acting hydraulic ram. A series of formers are provided, each having, in plan, a semi-circular anvil mountable to face the clamping means. The anvils are each of concave vertical cross-section and of different radius from one another, with peripheral walls to locate a pipe in position in the anvil during a bending operation. The ram is supplied from a tank containing a hydraulic fluid tank which—together with the necessary hydraulic pump and electric motor—is mounted beneath the work surface.

2 Claims, 4 Drawing Figures

PIPE-BENDING APPARATUS

FIELD OF THE INVENTION

The invention relates to pipe-bending apparatus.

REVIEW OF THE PRIOR ART

The oldest traditional method of bending circular-section pipes into a curve involves filling the pipe with sand; plugging the filled pipe at both ends; forcibly bending the pipe into the desired curve; and then unplugging it to allow the sand to drain out. Heat may be applied during the bending process, to assist the pipe to form the required curve.

This method is simple and cheap, but is often not accurate. The behaviour of the pipe cannot always be predicted, and the pipe may crease or flatten without warning as the bend is formed. The process is essentially not suited to repeated accurate production of pipe bends.

Pipe-bending machines are available, but again these are usually aimed at a fairly cheap market. They consist essentially of a forming head, on one side of which a simple clamp is located. In use, a length of pipe is held in the clamp, and is then manually stretched around the forming head. The head itself is shaped to the desired curve to be formed in the pipe.

Such machines enable accurate curves to be repeatedly formed, but again the behaviour of the pipe cannot always be accurately controlled.

SUMMARY OF THE INVENTION

According to the present invention, there is provided a pipe-bending apparatus comprising an elongate structure having a longitudinal work surface at or adjacent to opposite ends of which clamping means and a former are mounted respectively, the former being held fast on said surface and the clamping means being constrained to move relative theretowards longitudinally along the top of said surface, the clamping means having a pair of vertically spaced transverse arms extending beyond each longitudinal side of the surface, and having therebetween at or adjacent to each opposite end thereof, a pipe clamping device, and power means to stroke said clamping means to and from said former, said former being positioned so that on an outward stroke of said clamping means, the arms thereof can pass above and below said former respectively.

Preferably, the clamping means tracks a rail provided on said surface.

Preferably also, a series of formers are provided, each having, in plan, a semi-circular anvil mountably to face the clamping means, the anvils each being of concave peripheral cross-section and of different radius from one another, with peripheral walls to hold a pipe to be bent in position in the anvil during a bending operation.

Preferably also, the work surface is provided by the upper surface of an elongate structure having surface-engaging supports extending downwardly therefrom.

BRIEF DESCRIPTION OF THE DRAWINGS

An embodiment of the invention is shown, by way of example, in the accompanying drawings, in which.

DESCRIPTION OF THE PREFERRED EMBODIMENT

Figure 1:
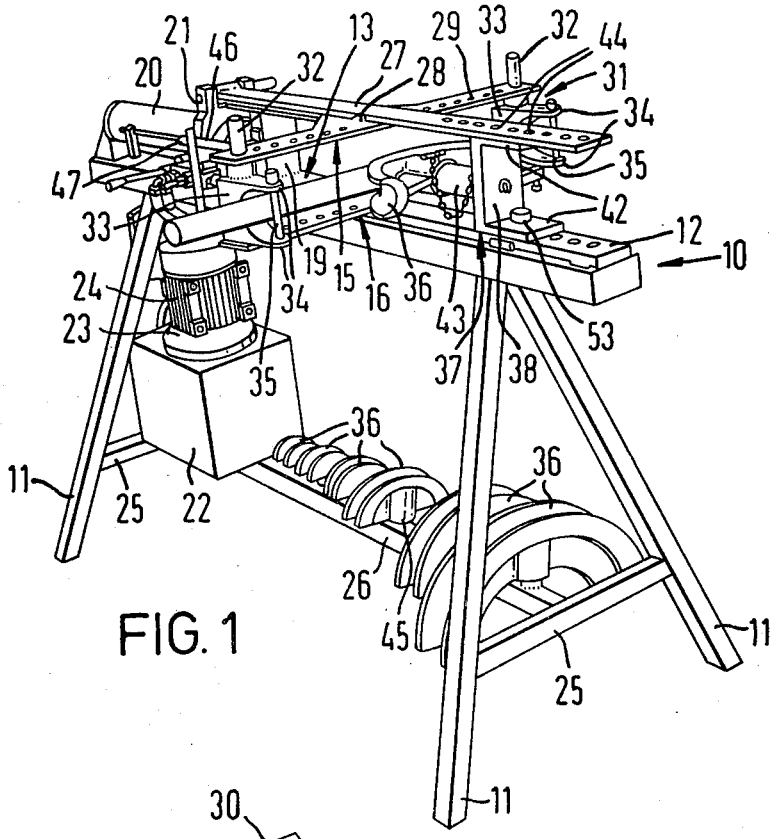
FIG. 1 is a prespective view of the pipe-bending apparatus embodying the invention.

A pipe-bending apparatus comprises an elongate rectangular structure 10 having surface-engaging supports 11, namely four legs, extending downwardly one from each corner of the structure. The upper surface of the structure 10 provides a longitudinal work surface. One end, and a major part of the length of which the surface extending from said one end, is formed by a rail 12. The rail 12 is spaced above (and separate from) the opposed longitudinal sides of the structure 10, but is otherwise supported on said structure 10.

At opposite ends of the rail 12, clamping means 13 and a forming assembly 14 are mounted. The forming assembly 14 is mounted (as will be described) towards one end of the rail 12, whilst the clamping means 13 is located at the opposite end of the rail 12.

The clamping means 13 comprises an upright back plate 19 mounted between, and spacing apart, two similar vertically-spaced members 15 and 16. These members 15, 16 extend from the back plate 19 in the direction of the forming assembly 14. Each of the members 15 and 16 is of T-shape (when viewed in plan) with the cross-piece of the T at the forming assembly end of each member 15, 16. The cross-pieces of said members 15 and 16 constitute transverse arms 17 which extend beyond each longitudinal side of the structure 10, and the stems 18 of said members 15 and 16 are parallel with the work surface. The stem 18 of the bottom member 16 has a downwardly-bent portion along each of its longitudinal sides, and a flange extends inwardly at the outer end of said bent portion.

The clamping means 13 tracks the rail 12. The stem of the bottom member 16 is slid along the rail 12 from one end thereof before mounting the forming assembly 14 thereon, so that the flanges underlie the rail on each side thereof.

Power means to stroke the clamping means towards and away from the forming assembly 14 comprises a double-acting hydraulic ram 20 which is located at the non-rail end of the work surface. The outer end of the piston of this ram 20 is secured to the back plate 19 of the clamping means 13. The cylinder of the ram is made fast to the mountings 21 which are upstanding from the work surface. One mounting 21 is secured at the back or outer end of the ram cylinder. The second mounting 21 encompasses the cylinder adjacent its front end.

The ram 20 is in circuit with a tank 22 containing hydraulic fluid. The fluid is fed to the ram 20 by a hydraulic pump 23 which is located in said tank 22 and is operable by an electric motor 24 mounted on top of the tank 22. The two legs 11 at each end of the elongate structure 10 are braced together by a respective stay 25. The two stays 25 are themselves braced apart by a tie 26 which runs below and parallel with the structure 10. The tank 22 is mounted on the tie 26 at one end thereof below the ram 20.

An elongate bar 27 is pivoted at one end to the second mounting 21 at a position above the cylinder 20, and is movable to an in-use position in which it is parallel to, above, and overlying the rail 12. In that position, a hole in the bar 27 engages a stub pin 30 on top of the forming assembly 14. The clamping means 13 moves between the rail 12 and bar 27. The top of the cross-piece 17 of the upper memeber 15 has (preferably) two projections 28 transversely spaced apart across the width of the bar 27, so that the bar 27 lies between the projections 28 and the projections act as a guide, during movement of the clamping means, to maintain the clamping means in a correct position. Only one projection 28 need be provided, as shown in the drawings.

Both cross-pieces of the members 15 and 16 have a similar series of equi-spaced holes 29 midway along their lengths. At each end, between the two members, a pipe-clamping device 31 is located. Each device 31 comprises a block 33 from which a stub rod 32 projects from both the top and bottom of the block for location in vertically-aligned holes 29 in the members 15 and 16. The top stub rod 29 of each block 33 is longer than the bottom stub rod 29. Two arms 34 extend out from, and are spaced apart from, the block 33, one from the top of the block 33 and one from the bottom thereof. At their outer ends, these arms 34 have a series of holes, between aligned vertical pairs of which a bolt 35 can be located and secured. In each block 33, the face between the two arms 34 and near to the bolt 35 is concaved to seat a pipe therein, the bolt 35 being positioned to hold the pipe tightly in position in the seat.

The series of holes in both arms are provided to enable various diameter-sized pipes to be used. The holes in the cross-pieces of the members 15, 16 are to allow the bends to be made at different lengths along the pipe to be bent.

The pipe-clamping devices 31 can pivot relative to said cross-pieces, and the concave faces of the blocks face towards the forming assembly 14.

Figure 4:
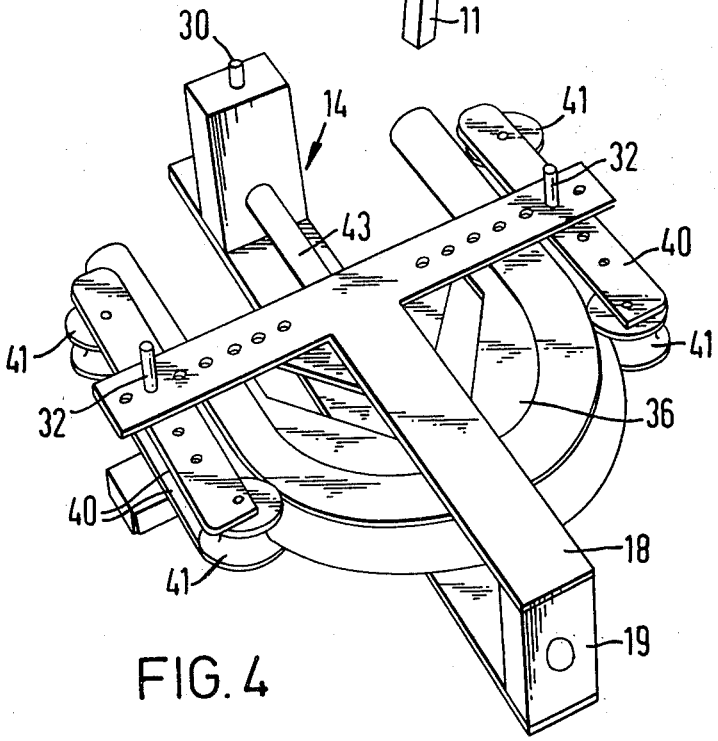
FIG. 4 is a prespective view of part of the apparatus.

If bends of 180° are required, modified devices 39 as shown in FIG. 4 are used. These devices 39 each comprise two vertically spaced arms 40 between aligned holes provided in the arms. Rollers 41 are located between the arms 40. The arms 40 have stub rods 32 projecting upwardly and downwardly to engage in holes 29 of the members 15 and 16. The position of the rollers 41 can be altered to suit the type and diameter of pipe to be bent.

A series of forming heads 36 is provided, each for mounting on a bracket 37 having an upright plate 38 with two arms 42 extending at right angles thereto from the top and bottom thereof. A pin 43 extends from the upright plate 38. The pin 43 extends parallel to said arms 42 but in the opposite direction thereto. The upper arm 42 is provided with two studs 44. The studs 44 are spaced lengthwise of said upper arm 42 to be engaged by two of the holes in the bar 27. The holes in the rail 12 are tapped, and a screw-threaded stub bolt 53 with a knurled head passes through a hole in the bottom arm 42 to engage with the thread of a hole in the rail 12 and so to fasten the bracket 37 to the rail. The bracket 37 is mounted in position with the pin 43 pointing towards the clamping means 13, and serves to space the bar 27 from the rail 12 at that end.

A forming head 36 is mounted at the outer end of the pin 43. A tubular portion of the head 36 fits around said pin 43 and is secured in position. Each forming head 36 has, in plan, a semi-circular anvil of concave vertical cross-section, and each is of different radius to the others of the series. An upper and lower side wall are provided to hold a pipe to be bent in position in the anvil during a bending operation.

The anvils of the forming heads 36 when mounted, one at a time, face the clamping means. The forming head 36 is located at a height between said members 15 and 16 such that, on an outward stroke of said clamping means 13, the members can pass respectively above and below the forming head 36. A number of spaced-apart pins 45 equal to the number of forming heads 36 are provided upstanding from the tie 26. The forming heads, when not in use, can be stored on these pins.

A guide rod 46 is mounted on the back plate 19 of the clamping means 13. It extends towards, and moves parallel to, the ram 20 when the ram piston is extended to move the back plate 19. The guide rod 46 is in sliding engagement with a tubular sleeve 47 of the second mounting 21. It carries at (or adjacent) its outer end a stop 48 which can be located therealong at any selected position. The stop 48 has a forwardly-extending projection 49 which is spring-biased outwardly. A pivoted finger 51 is mounted near the projection 49 to abut it just below the pivot. The bottom of the finger 51 hangs down to abut against a forward/reverse control valve having a lever 50 mounted on said second mounting 21. When the projection 49 abuts the finger 51 as the ram extends the clamping means, the biasing spring is compressed until there is such pressure on the finger 51 that it moves pivotally to operate the lever of the valve 50 to reverse the movement of the ram.

To bend a pipe, the lead from the motor is connected to an electric supply, the piston of the ram is retracted, and the desired radius of the forming head 36 is selected and then fitted to the bracket 37 which has been positioned at the required location on the rail 12. The bar 27 is pivoted away from its in-use position to an out-of-use position. The bolts 35 of the pipe-clamping devices 31 are removed and a pipe is located between the two blocks 33, the devices 31 first of all having been positioned as required at one of the positions as hereinbefore described. The bolts 35 are replaced and the bar 27 moved to its in-use position with two of its holes engaged by the two studs 44 on the upper arm of the bracket 37. The piston is stroked outwards. As the clamping means 13 is being moved forward, the pipe engages the anvil and is held in position by the walls. On further movement, it bends around the anvil. The piston is retracted, the bar moved to an out-of-use position, and the bent pipe removed after the bolts are removed.

Figure 2:
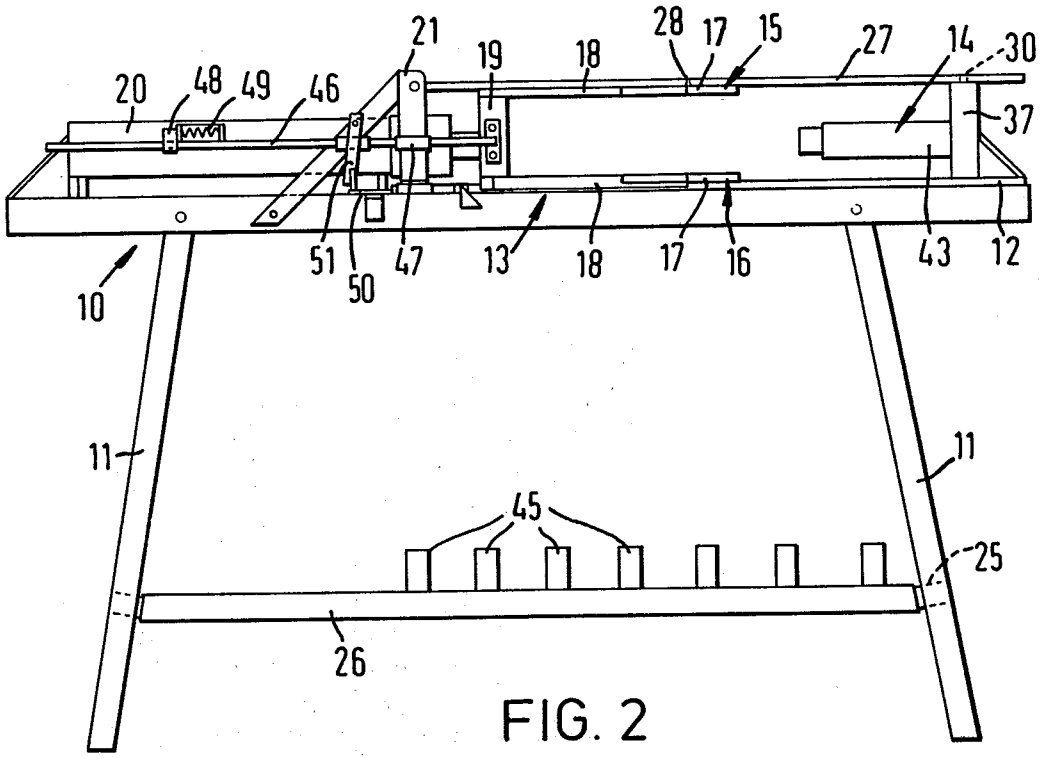
FIG. 2 is a side elevation of the apparatus.
Figure 3:
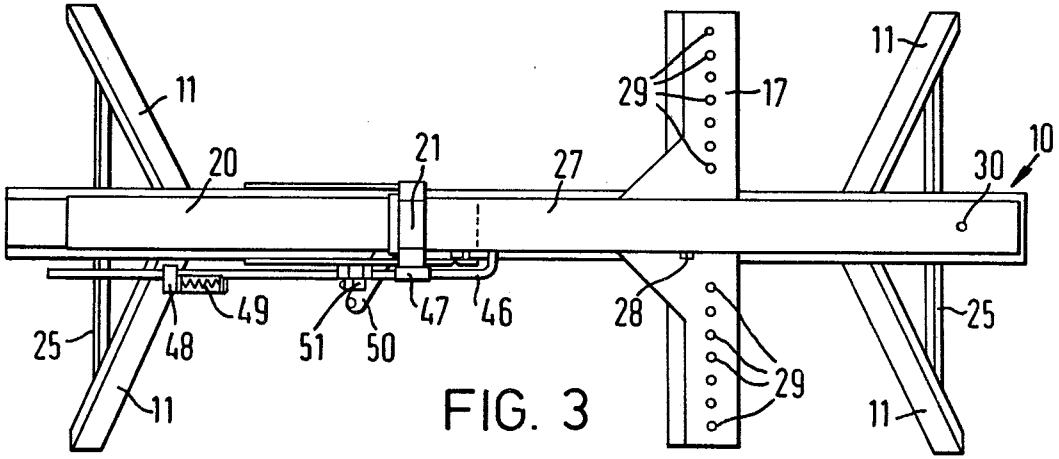
FIG. 3 is a plan view of the apparatus.

In a modification, the brackets 37 is fixed to the rail and cannot be moved relative to the rail. Such a modification is shown in FIGS. 2, 3 and 4.

We claim:

1. A pipe-bending apparatus comprising:

an elongated structure having a longitudinal work surface;

a clamping means comprising a pair of vertically-spaced transverse arms with a respective pipe-clamping device towards each opposite end thereof;

each clamp device including a pivotal support on both adjacent arm ends so as to be pivotal with respect thereto and also including means for detachably clamping a pipe to be bent so as to permit support of the pipe with respect to the arms before, during, and after bending of the pipe;

means mounting said clamping means towards one end of said work surface with said transverse arms extending beyond each longitudinal side of said surface;

a forming head;

means mounting said forming head towards the other end of said work surface;

and power-operated means to drive said clamping means along said work surface selectively towards and away from said forming head;

said clamping means and forming head being so sized and positioned relative to one another that, on an outward stroke of said clamping means, said transverse arms can pass one above and one below said forming head.

2. Apparatus as claimed in claim 1, wherein the power means is a double-acting hydraulic ram, and further comprising a tank containing hydraulic fluid, an electric motor mounted on the outside of said tank means for directing fluid supply from said tank to said ram; and said tank, pump and electric motor being located beneath said work surface.

* * * * *

UNITED STATES PATENT AND TRADEMARK OFFICE

CERTIFICATE OF CORRECTION

PATENT NO. : 4,265,106

DATED : May 5, 1981

INVENTOR(S) : Tom McMaster et al

It is certified that error appears in the above—identified patent and that said Letters Patent is hereby corrected as shown below:

Column 4, lines 16 and 17 (Page 7, lines 35 and 36), "control valve having a lever 50" should be --control valve 50 having a lever--

Signed and Sealed this

*Twenty-fifth* Day of *August 1981*

[SEAL]

*Attest:*

GERALD J. MOSSINGHOFF

*Attesting Officer*

*Commissioner of Patents and Trademarks*